United States Patent [19]

Pyle et al.

[11] Patent Number: 4,798,147

[45] Date of Patent: Jan. 17, 1989

[54] DRIVE WHEEL ADJUSTER FOR DRIVERLESS VEHICLE

[75] Inventors: Roger A. Pyle, Wind Gap; Per E. Lindovist, Easton, both of Pa.

[73] Assignee: SI Handling Systems, Inc., Easton, Pa.

[21] Appl. No.: 41,176

[22] Filed: Apr. 22, 1987

[51] Int. Cl.[4] ..... B61B 13/12

[52] U.S. Cl. ..... 104/166

[58] Field of Search ..... 104/166, 165

[56] References Cited

U.S. PATENT DOCUMENTS

| | | | |
|---|---|---|---|
| 402,934 | 5/1889 | Judson | 104/166 |
| 3,621,790 | 8/1969 | Broome | 104/166 |
| 3,842,752 | 10/1974 | Harwick | 104/166 |
| 4,347,792 | 9/1982 | Nagahori | 104/166 |
| 4,358,999 | 11/1982 | Nagahori | 104/166 |
| 4,367,683 | 1/1983 | Tokunaga | 104/166 |
| 4,378,741 | 4/1983 | Nagahori | 104/166 X |
| 4,389,943 | 6/1983 | Watatani | 104/166 |
| 4,582,000 | 4/1986 | Lindquist | 104/166 |
| 4,593,623 | 6/1986 | Gutekunst et al. | 104/166 |

*Primary Examiner*—Robert B. Reeves
*Assistant Examiner*—Scott H. Werny
*Attorney, Agent, or Firm*—Seidel, Gonda, Lavorgna & Monaco

[57] ABSTRACT

A driverless vehicle having swivel-mounted support wheels which ride on track rails and at least first and second drive wheels adapted for frictional contact with a drive tube. The drive wheels are interconnected by a linkage permitting limited independent movement of the drive wheels through a track curve, and they are maintained in substantially synchronous angular orientations relative to the drive tube by means of a stationary cam and a follower mounted on one of the drive wheels or by means of a linkage interconnecting one of the support wheels with one of the drive wheels.

7 Claims, 4 Drawing Sheets

DRIVE WHEEL ADJUSTER FOR DRIVERLESS VEHICLE

BACKGROUND OF THE INVENTION

When driverless vehicles of the type employing two or more drive wheels powered by a rotating drive tube negotiate a curve, the drive wheels during any given instant of time experience different angular orientations relative to the drive tube. This results in the drive wheels being driven at different speeds. The drive wheels tend to buck or fight each other as they try to attain the speeds associated with their different angular orientations relative to the drive tube. As a consequence, one or more of the drive wheels experience excessive wear.

The present invention is directed to a solution to this problem.

SUMMARY OF THE INVENTION

The present invention is directed to a driverless vehicle having at least two drive wheels driven by a drive tube. The drive wheels are spring biased to a predetermined angular orientation with respect to the vehicle center-line. As the vehicle negotiates a track curve, the drive wheels tend to assume different angular positions relative to the drive tube. If permitted, this would cause the drive wheels to be driven at different speeds. The drive wheels would fight each other through the curve causing excessive wheel wear and inefficient operation. According to the present invention, an adjustment mechanism causes the drive wheels to assume substantially identical orientations relative to the drive tube throughout the track curve. There are two forms for such an adjustment mechanism.

In the preferred embodiment of the invention, the support wheels are swivel-mounted on the vehicle platform. As the vehicle negotiates a track curve, each support wheel follows the track rails and swivels relative to the vehicle platform. One support wheel is connected by a linkage to one drive wheel assembly which in turn is connected through a lost motion linkage to another drive wheel assembly. The linkage between the support wheel and a drive wheel assembly controls the angular disposition of the assembly drive wheel. The linkage between the drive wheel assemblies allows limited independent movement of the drive wheel assemblies while negotiating the track curve, and allows the drive wheel assemblies to operate normally in straight track sections.

By this arrangement, the drive wheels assume substantially the same angular orientations relative to associated sections of the drive tube over the track curve thereby preventing or substantially mitigating drive wheel wear. Test runs with and without the linkage of the present invention have produced dramatic differences in wheel wear. In one test, involving a radius turn of four feet and a conventional drive wheel arrangement, the rear drive wheel lasted about 400 hours or approximately 100,000 turns. With the linkage of the present invention, the drive wheel lasted over 1,400 hours at which time it showed no significant wear.

In an alternative embodiment of the invention, a cam follower is placed on one of the drive wheel assemblies which, in cooperation with a cam surface positioned adjacent the track curve, allows controlled movement of the drive wheel assembly as the vehicle negotiates the curve. A lost motion connection between both drive wheel assemblies allows limited independent movement of the drive wheel assemblies over the curve. This solution produced results similar to those using the support wheel linkage arrangement described above.

For the purpose of illustrating the invention, there is shown in the drawings forms which are presently preferred, it being understood, however, that this invention is not limited to the precise arrangements and instrumentalities shown.

DETAILED DESCRIPTION OF THE INVENTION

Figure 1:
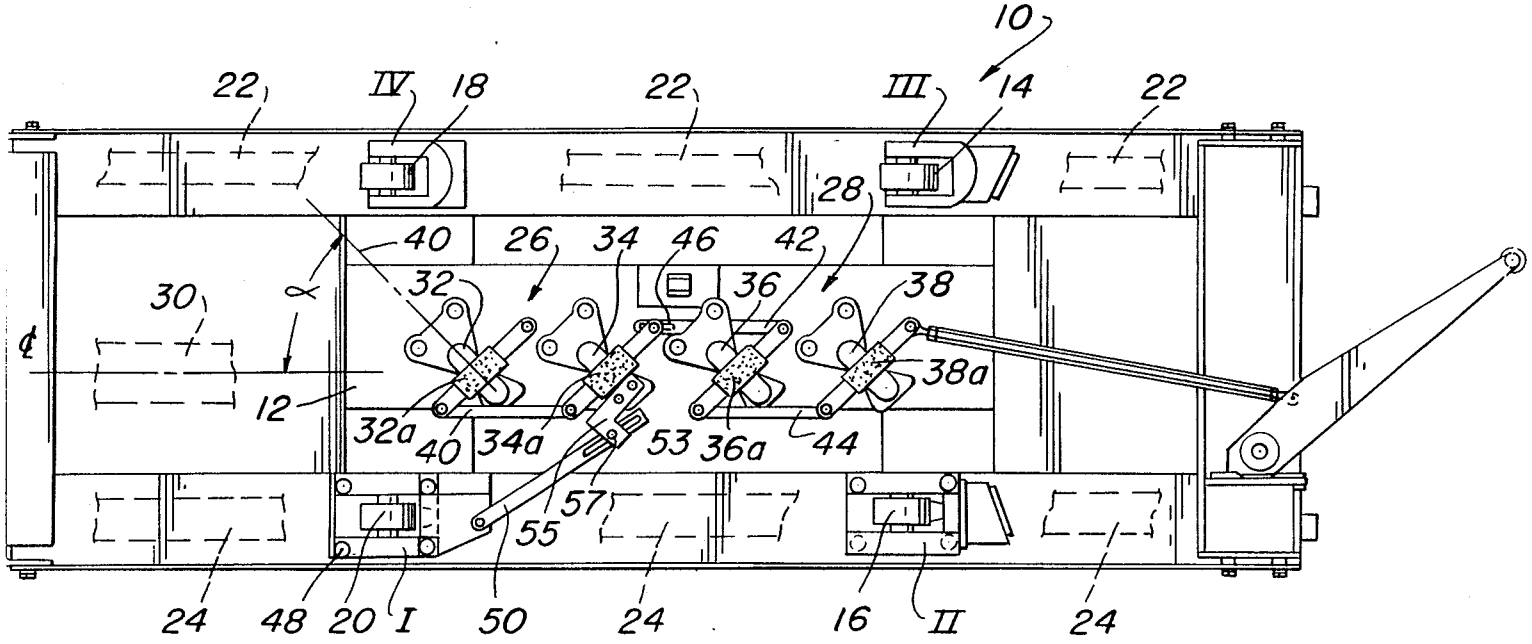
FIG. 1 is a bottom view of a driverless vehicle embodying a preferred form of the present invention.

In FIG. 1, the underside of a driverless vehicle 10 is shown having a platform 12 secured to the vehicle frame. Support wheels 14–20 ride along rails 22 and 24 of a track. The support wheels are rotatably supported on carriages I–IV which are swivel mounted on the vehicle frame. The vehicle 10 is propelled by contact between drive wheels mounted on two sets of conventional drive wheel support assemblies, generally designated 26 and 28, and contiguous rotating drive tube or shaft sections 30 positioned between the track rails.

Figure 4:
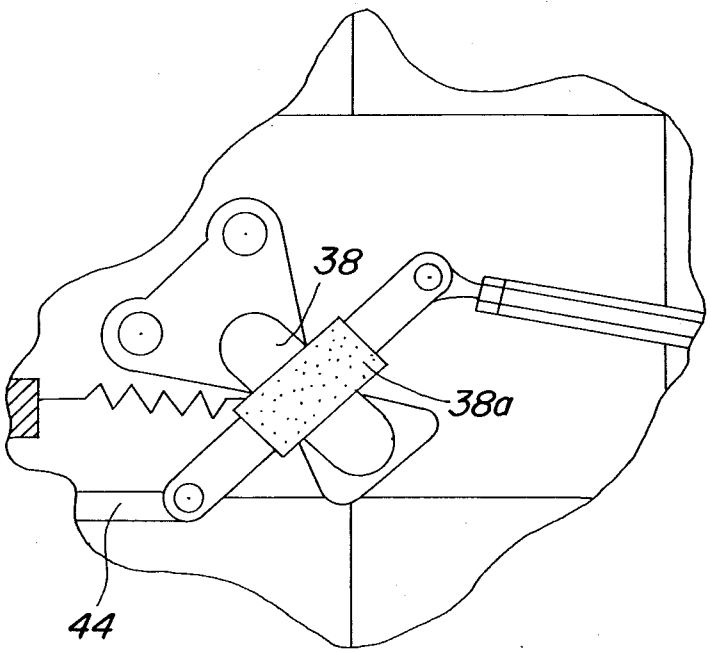
FIG. 4 is a schematic representation of a drive wheel biasing means.

Drive wheel support assemblies 32, 34, 36 and 38 comprise drive wheels **32*a*, 34*a*, 36*a* and 38*a* respectively and are attached to the underside of platform 12. Each assembly is rotatable about a vertical axis and is spring biased (shown schematically in FIG. 4) to a predetermined angular orientation with respect to the center-line of the vehicle platform as is well known in the art. Each of the drive wheels 32*a*, 34*a*, 36*a* and 38*a* is rotatable about a horizontal axis and is positioned to frictionally contact the rotating drive shaft 30. Each drive wheel assembly is typically spring biased to a position such that the horizontal axis of rotation of its drive wheel forms an angle of approximately 45° with respect to the centerline of the vehicle platform. See FIG. 1**.

As shown in FIG. 1, the center-line of the vehicle platform is assumed to be coincident with the longitudinal axis of drive shaft 30 along a straight section of track. Rotation of a drive wheel assembly about its vertical axis causes a change in the angle (designated alpha in FIG. 1) between the horizontal axis of rotation of its drive wheel and the longitudinal axis of the drive shaft. The speed of the driverless vehicle varies accordingly. A drive wheel has negligible forward thrust when the alpha angle is approximately 0°. Maximum speed of a driverless vehicle 10 is obtained when the alpha angle approximates 45°.

To produce controlled synchronous movement of the sets of drive wheel assemblies 26, 28 according to the invention, the drive wheel assemblies are interconnected by linkages 40, 42 and 44. The drive wheel assemblies in set 26 (28) are slaved to each other by linkage 40 (44). A lost motion slot 46 is provided in linkage 42 to permit limited independent movement of the two sets of drivewheel assemblies as described more fully hereafter.

The angular orientation of each drive wheel relative to an associated drive tube section at any instant of time depends on the location of the vehicle on the track curve. This can best be visualized by reference to FIG. 2. As the vehicle approaches a track curve, moving to the right in FIG. 2, the rear support wheel 20 tracks the curvature of the rail 24 by means of guide rollers 48 mounted on each corner of the support wheel carriage I. The rollers 48 are designed for rotation about a vertical axis and maintain rolling contact with the sides of the rail as the vehicle traverses the track curve. The support wheel carriage I is used to control movement of the drive wheel assemblies 32, 34 by means of a linkage 50. One end of the linkage 50 is pivotably mounted at 52 to a forwardly projecting portion of the support wheel carriage. (The other end of the linkage 50 is pivotably coupled to drive assembly 34.) Linkage 50 is provided with a slot 53, and a bracket 55 is secured to drive wheel assembly 34 and provided with a pin 57 which rests in slot 53.

Drive wheel assembly 34 is also slaved by linkage 40 to drive wheel assembly 32, and by lost motion linkage 42 to drive wheel assembly 36. Thus, one end of linkage 40 is pivotably connected at 59 to drive wheel assembly 34, and the other end of linkage 40 is pivotably connected at 61 to drive wheel assembly 32. As previously indicated, the linkage 42 interconnecting drive wheel assemblies 34, 36 is provided with a lost motion slot 46 to permit limited independent movement between the drive wheel assemblies as the vehicle negotiates the track curve and allows the drive wheel assemblies to operate normally over straight track sections. One end of linkage 42 is pivotably coupled at 67 to drive wheel assembly 36. Drive wheel assembly 34 is provided with a pin 69 which rides in the lost motion slot 46. The slot 46 in link 42 is of sufficient length to accomodate differences in angular orientation between the two sets of drive wheel assemblies relative to the vehicle center-line as may be required to bring the two sets of drive wheel assemblies into substantially the same angular orientation relative to their associated drive tube sections along the track curve at any instant of time. The second drive wheel assembly 36 is in turn slaved to drive wheel assembly 38 by linkage 44. One end of linkage 44 is pivotably connected at 63 to drive wheel assembly 36, and the other end of linkage 44 is pivotably connected at 65 to drive wheel assembly 38.

Figure 2:
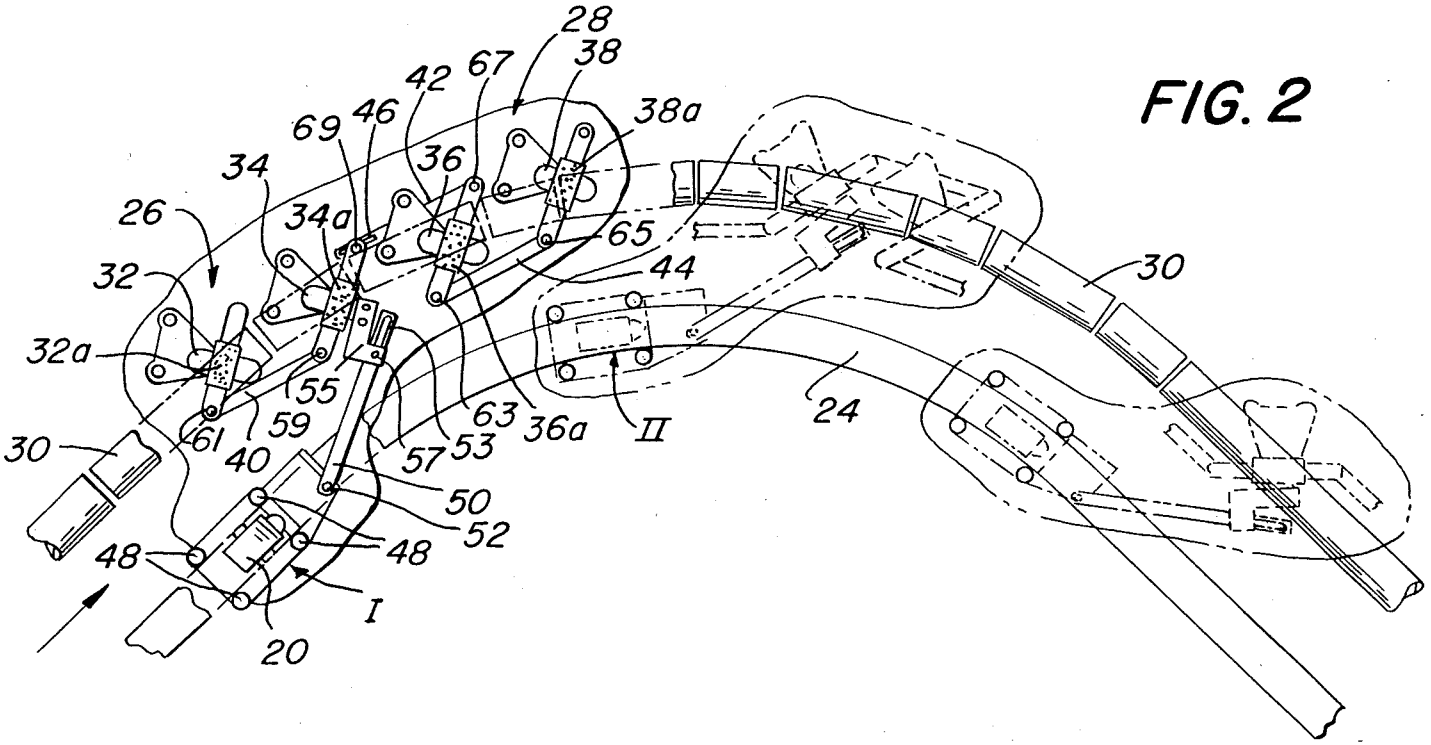
FIG. 2 is a bottom view of a driverless vehicle illustrating operation of the invention in the negotiation of a track curve.

By the arrangement shown in FIGS. 1 and 2, the drive wheels are caused to assume substantially the same angular orientations with respect to their associated drive shaft sections 30 as the vehicle negotiates the track curve. Accordingly, there is minimal fighting or bucking between the drive wheels, and the transition through the track curve is essentially without frictional wear.

In operation, as the vehicle enters the track curve as seen in FIG. 2, the center-line of the vehicle platform rotates clockwise. The drive wheels of the drive wheel assemblies in set 28 remain spring biased at approximately 45° relative to the center-line of the vehicle platform. Because the drive shaft sections are angled with respect to each other through the track curve, the angle alpha for each of the drive wheels in drive wheel assembly set 28 is less than 45°. The drive wheels of the drive wheel assemblies in set 26 also tend to seek an angular orientation of approximately 45° with respect to the center-line of the vehicle platform under spring pressure, but they are displaced from that orientation by link 50 which acts on bracket 55 so as to overcome the spring pressure. The location of the pivot connection of bracket 55 and linkage 50 is chosen to ensure that the alpha angle of the drive wheels in drive wheel assembly set 26 is controlled so as to track the alpha angle of the drive wheels in drive wheel assembly set 28.

Thus, as the rearmost support wheel carriage I enters the curve it swivels about a vertical axis in a clockwise direction, and link 50 controls angular displacement of the rear set of drive wheel assemblies 26 so as to maintain the alpha angle of the rear set of drive wheels 32*a*, 34*a* substantially the same as the alpha angle of the front set of drive wheels 36*a*, 38*a*. As the vehicle exits the curve, the alpha angle of the forward set of drive wheels gradually increases to 45°, and link 50 permits the rear set of drive wheels to pivot gradually under spring force towards an angle of 45° with respect to the platform centerline so that the alpha angle of the rear set of drive wheels continues to track the alpha angle of the front set of drive wheels.

Figure 3:
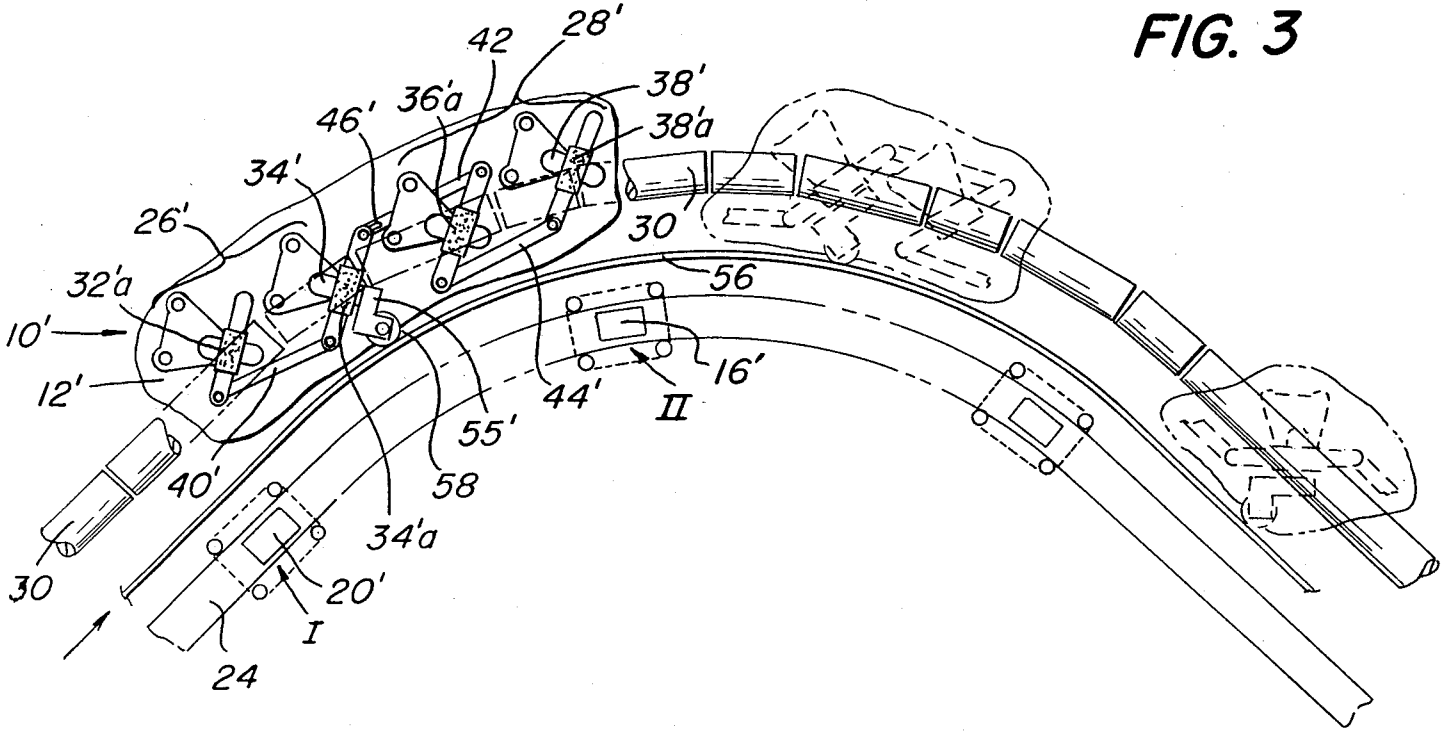
FIG. 3 is a bottom view of a driverless vehicle depicting an alternative form of the invention.

An alternative approach for achieving controlled synchronized movement of the drive wheels to substantially the same alpha angles over a track curve is shown diagramatically in FIG. 3. In FIG. 3, the drive wheel assembly 34' is provided with a cam follower roller 58 on bracket 55'. As the vehicle travels through the track curve, the front drive wheels 36'*a*, 38'*a* move synchronously, independently of drive wheels 32'*a*, 34'*a*, each set interconnected by means of linkages 40',44' in the same manner as discussed with respect to the embodiment shown in FIGS. 1 and 2. In addition, the cam follower roller 58 is contacted by a cam surface 56 disposed between the drive tube and rail 24, which overcomes the spring pressure on rear drive wheel 34'*a* (hence rear drive wheel 32'*a*). Accordingly, the rear drive wheels do not orient at 45° with respect to the platform center-line. The location of the cam surface along the curve is chosen to ensure that the alpha angle of the rear drive wheels tracks the alpha angle of the front drive wheels through the curve.

The theory of application described above is equally applicable to an embodiment wherein only two drive wheels are employed, i.e. a single front drive wheel and a single rear drive wheel, or wherein each set includes two or more drive wheels, and to left turns as well as right turns.

Each of the two approaches for achieving controlled, drive wheel speed sychronization has proved equally effective. However, it is simpler to use one of the support wheels as the control element as shown in FIGS. 1 and 2.

The present invention may be embodied in other specific forms without departing from the spirit or essential attributes thereof and, accordingly, reference should be made to the appended claims, rather than to the foregoing specification, as indicating the scope of the invention.

We claim:

1. A driverless vehicle which is propelled by a drive tube and having support wheels for guiding the vehicle over a track which includes a drive tube following a curve, comprising:

a platform, said support wheels being mounted so as to swivel relative to said platform, at least two pivotable drive wheel assemblies, each including a drive wheel yieldingly biased to a predetermined angular orientation relative to the platform and adapted for frictional contact with said drive tube such that the angular orientation of each drive wheel with respect to the drive tube varies as the vehicle negotiates the track curve, and linkage means interconnecting said drive wheel assemblies and connecting at least one of said support wheels to at least one, but less than all of said drive wheel assemblies so as to control pivoting movements of the drive wheels of said at least one drive wheel assemblies such that, as the vehicle negotiates the track curve and the angular orientation of each drive wheel with respect to the drive tube varies, the angular orientation of said drive wheel of said one assembly with respect to the drive tube substantially matches the angular orientation of a drive wheel of the other of the drive wheel assemblies with respect to the drive tube.

2. A driverless vehicle which is propelled by a drive tube and having support wheels for guiding the vehicle over a track which includes a drive tube following a curve, comprising:

a platform, said support wheels being mounted so as to swivel relative to said platform, at least two pivotable drive wheel assemblies, each including a drive wheel yieldingly biased to a predetermined angular orientation relative to the platform and adapted for frictional contact with said drive tube such that the angular orientation of each drive wheel with respect to the drive tube varies as the vehicle negotiates the track curve,, linkage means interconnecting said drive wheel assemblies so as to permit limited independent pivoting movement thereof, and a cam follower mounted on one of said drive wheel assemblies and cam means disposed along the track curve so as to contact said cam follower and control pivoting movement of at least one, but less than all of the drive wheels of the drive wheel assemblies such that, as the vehicle negotiates the track curve and the angular orientation of each drive wheel with respect to the drive tube varies, the angular orientation of said drive wheel of said one assembly with respect to the drive tube substantially matches the angular orientation of a drive wheel of the other of the drive wheel assemblies with respect to the drive tube.

3. A driverless vehicle which is propelled by a drive tube and having support wheels for guiding the vehicle over a track which includes a drive tube following a curve, comprising:

a platform, said support wheels being mounted so as to swivel relative to said platform, at least two drive wheels each mounted on said platform so as to pivot about a vertical axis and yieldingly biased to a predetermined angular orientation relative to the platform and adapted for frictional contact with said drive tube such that the angular orientation of each drive wheel with respect to the drive tube varies as the vehicle negotiates the track curve, linkage means interconnecting said drive wheels so as to permit limited independent pivoting movement thereof, and means for controllably pivoting at least one but less than all of said drive wheels such that, as the vehicle negotiates the track curve and the angular orientation of each drive wheel with respect to the drive tube varies, the angular orientation of said one drive wheel with respect to the drive tube substantially matches the angular orientation of the other drive wheel with respect to the drive tube.

4. A driverless vehicle according to claim 1 or claim 2 wherein said linkage means is provided with a lost motion connection between said drive wheel assemblies.

5. A driverless vehicle according to claim 1, 2, or 3 wherein each of said drive wheels is springbiased towards a position such that the horizontal axis of rotation of the drive wheel is approximately 45° with respect to the direction of travel of the vehicle.

6. A method of limiting the wear experienced by the drive wheels of a driverless vehicle as the vehicle negotiates a track which includes a drive tube following a curve, the vehicle having two or more pivotable drive wheels each powered by the drive tube and yieldingly biased to a predetermined angular orientation relative to the direction of travel of the vehicle such that the angular orientation of each drive wheel with respect to the drive tube varies as the vehicle negotiates the track curve, comprising:

controllably varying the angular orientation of at least one but less than all of said drive wheels with respect to the drive tube such that, as the vehicle negotiates the track curve and the angular orientation of each drive wheel with respect to the drive tube varies, the angular orientation of said at least one drive wheel with respect to the drive tube substantially matches the angular orientation of the other drive wheel with respect to the drive tube.

7. A driverless vehicle which is propelled by a drive tube and having support wheels for guiding the vehicle over a track which includes a drive tube following a curve, comprising:

a platform, said support wheels being mounted so as to swivel relative to said platform, at least two drive wheels yieldingly biased to a predetermined angular orientation relative to the platform and adapted for frictional contact with said drive tube such that the angular orientation of each drive wheel with respect to the drive tube varies as the vehicle negotiates the track curve, and means for controllably pivoting at least one, but less than all of said drive wheels so as to vary the angular orientation thereof with respect to the platform as the vehicle negotiates the track curve such that the angular orientation of the drive wheel with respect to the drive tube substantially matches the angular orientation of the other of the two drive wheels with respect to the drive tube as the vehicle negotiates the track curve.

* * * * *